US010746465B2

(12) United States Patent
Bell et al.

(10) Patent No.: US 10,746,465 B2
(45) Date of Patent: Aug. 18, 2020

(54) GRAIN AND CROP DRYING METHOD, SYSTEM, AND APPARATUS

(71) Applicant: ConleyMax Inc., Calgary (CA)

(72) Inventors: Patrick G. Bell, Calgary (CA); William N. Beckie, Calgary (CA)

(73) Assignee: ConleyMax Inc., Calgary, Alberta (CA)

( * ) Notice: Subject to any disclaimer, the term of this patent is extended or adjusted under 35 U.S.C. 154(b) by 284 days.

(21) Appl. No.: 15/606,712

(22) Filed: May 26, 2017

(65) Prior Publication Data

US 2018/0283787 A1 Oct. 4, 2018

Related U.S. Application Data

(60) Provisional application No. 62/480,013, filed on Mar. 31, 2017.

(51) Int. Cl.

| | |
|---|---|
| ***F26B 19/00*** | (2006.01) |
| ***F26B 3/06*** | (2006.01) |
| ***F26B 9/06*** | (2006.01) |
| ***F26B 21/00*** | (2006.01) |

(52) U.S. Cl.

CPC ..... *F26B 19/005* (2013.01); *F26B 3/06* (2013.01); *F26B 9/063* (2013.01); *F26B 21/001* (2013.01); *F26B 2200/06* (2013.01)

(58) Field of Classification Search

CPC ..... F26B 19/005; F26B 21/001; F26B 9/063; F26B 3/06; F26B 2200/06

See application file for complete search history.

(56) References Cited

U.S. PATENT DOCUMENTS

| | | | | | |
|---|---|---|---|---|---|
| 2,551,215 | A * | 5/1951 | Lytton | A24B 1/02 | 432/176 |
| 2,714,258 | A * | 8/1955 | Smith | F26B 21/00 | 298/1 H |
| 4,307,701 | A * | 12/1981 | Balon | F24H 3/0488 | 126/110 B |
| 7,814,677 | B2 * | 10/2010 | Brewer | A45D 20/12 | 132/271 |
| 2004/0022627 | A1 * | 2/2004 | Hanchett | F04D 29/441 | 415/211.2 |
| 2010/0170105 | A1 * | 7/2010 | Burns | F26B 9/063 | 34/475 |
| 2011/0167667 | A1 * | 7/2011 | Zoucha | F26B 17/14 | 34/267 |

FOREIGN PATENT DOCUMENTS

| | | | | |
|---|---|---|---|---|
| FR | 2480920 A2 | 10/1981 | | |
| GB | 1030445 A * | 5/1966 | | F26B 9/103 |
| WO | WO-8707937 A1 * | 12/1987 | | F26B 3/06 |

OTHER PUBLICATIONS

Canadian Office Action dated Oct. 3, 2018 for Canadian Patent Application No. 2,968,123.

* cited by examiner

*Primary Examiner* — Jessica Yuen

(57) ABSTRACT

A grain dying system for a grain bin that includes a heating unit arranged in a proximity of the grain bin and ducting connected at one end to the heating unit and another end to a grain drying adaptor. The grain drying adaptor is connected at one end to the ducting and at another end to a fain unit of an aeration system for the grain bin. The fan unit is attached to the grain drying adaptor. The grain drying adaptor is configured to introduce a blend of heated air from the heating unit and ambient air from outside the grain drying adaptor into the aeration system of the grain bin.

9 Claims, 5 Drawing Sheets

GRAIN AND CROP DRYING METHOD, SYSTEM, AND APPARATUS

FIELD OF THE INVENTION

This invention generally relates to introducing heated air stream (heated air flow) from a heating unit to an aeration system of a grain bin (grain elevator) to provide a continuous flow of temperature controlled air into the bin to dry the grain or crops stored inside the bin.

BACKGROUND OF THE INVENTION

Grain drying is a process of drying grain to reduce or prevent spoilage and to inhibit microbial growth during storage. This process is used to reduce the moisture content of wheat, soybean, rice, barley, oats, etc. To dry grain, common practice has been for a farmer employee to haul grain from their bin to a commercial dryer, or to shuttle grain back and forth from their bin to their own on-farm grain dryer. Plus, one problem with using traditional commercial mechanical dryers when drying a crop like lentils, for example, is that the process chips the lentils, which takes the grade off of the lentils. According to one calculation, the cost of downgrading from a No. 1 quality lentil to a No. 2 quality lentil is $7.57 a bushel, or $36,000 per quarter section, based on an average yield of 30 bushels per acre. Traditional drying process not only increase the chances of kernel damage, but are also time consuming, expensive, inefficient, and potentially dangerous.

The present invention removes these problems by utilizing a heating unit, ducting (e.g., hose), and grain drying adapter to introduce heated air directly into an aeration system included on many grain bins. The heating unit may be a mobile device and may be a flameless unit, such as the flameless heater as described in U.S. application Ser. No. 13/834,942, or a conventional straight air heater. This system gives farmers the ability to more effectively dry down grain without having to move it out of the bins, saving time, equipment, and trucking costs. Plus, multiple bins can be dried with a single heating unit (e.g., heat exchanger). Moreover, since this system may be portable, it is beneficial for remote locations that lack access to power. Also, there is no risk of explosion or burns due to open flames or high-temperature steam, which also makes this system safer to operate around grain dust than flame-based heaters. Plus, using the aeration system on the grain bin alone to dry the grain has negative effects on the drying process when the outside temperature changes, e.g., unseasonable temperature, nighttime temperature, high or low humidity situations, etc. The present system introduces a predetermined air temperature into the aeration system, day and night.

SUMMARY OF THE INVENTION

This invention comprises three major components: heating unit, ducting, and grain drying adapter. The heating unit is arranged in the proximity of a grain bin. The ducting is connected at a first end to an outlet portion of the heating unit. The ducting is connected at a second end (distal end, opposite end) to a first side of a grain dryer adapter. The grain dryer adapter is connected at a second side (opposite side) thereof to a fan unit of an aeration system for a grain bin. The grain dryer adapter unit is configured with spaced through-holes to introduce a desired volume of ambient air into the fan.

In operation, a blend of heated air from the running heating unit and ambient air from the through-holes is introduced to the fan and circulated into the bin via the aeration system.

Other objects and features of this invention will be in part apparent and in part point pointed out hereinafter.

BRIEF DESCRIPTION OF THE DRAWINGS

The following drawings illustrate examples of various components of the invention disclosed herein, and are for illustrative purposes only.

DETAILED DESCRIPTION OF THE INVENTION

While the present invention may be embodied in many different forms, several illustrative embodiments are described herein with the understanding that this disclosure is to be considered as providing examples of the principles of the invention and such examples are not intended to limit the invention to the preferred embodiments described herein and/or illustrated herein.

Figure 1:
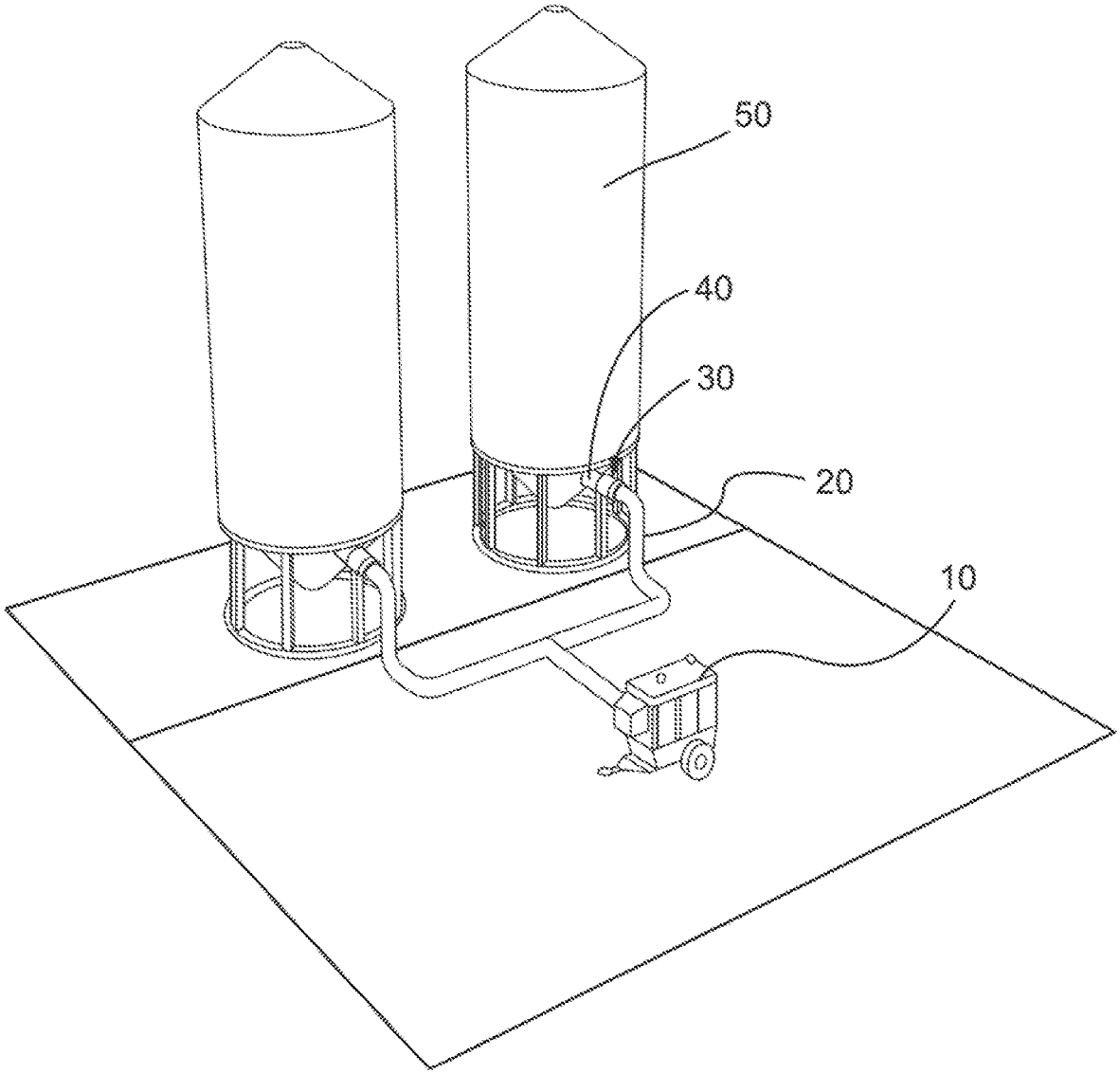
FIG. 1 illustrates a grain drying apparatus attached to an aeration system of a grain bin.

Reference will now be made to FIG. 1, an illustrative view of a grain drying apparatus attached to an aeration system of a grain bin. Each component will be described in detail, followed by an overview of the system.

FIG. 1 illustrates a heating unit 10, preferably mobile, that is arranged in proximity to grain bin (or elevator) 50. The heating unit 10 may be designed with safety features including positive air shut off, brushless alternator, secondary liquid containment and emergency stop button to reduce risk to grain and facilities. The grain bin 50 in this embodiment is equipped with an aeration system (not shown, but in general comprises a fan 40 designed to blow ambient air through a central duct in the bin 50), including fan 40. During operation, the heating unit 10 is configured to release air heat via the outlet component. Ducting 20 (e.g., 16" diameter, but any appropriately sized ducting can be used, and 25-50' long, but any appropriately length ducting can be used) is attached at one end to the outlet component of the heating unit 10 and at the other end to either the fan 40 or to a grain drying adapter 30 (described below), which is attached to the fan 40. The air released from the heating unit 10 flows through the ducting 20 and is ultimately introduced into the fan 40 of aeration system of one or more gain bins 50. In this embodiment, for example, the ducting 20 is designed with a single inlet communicating with the outlet component and two outlets communicating with first and second grain bins 50.

Figure 2:
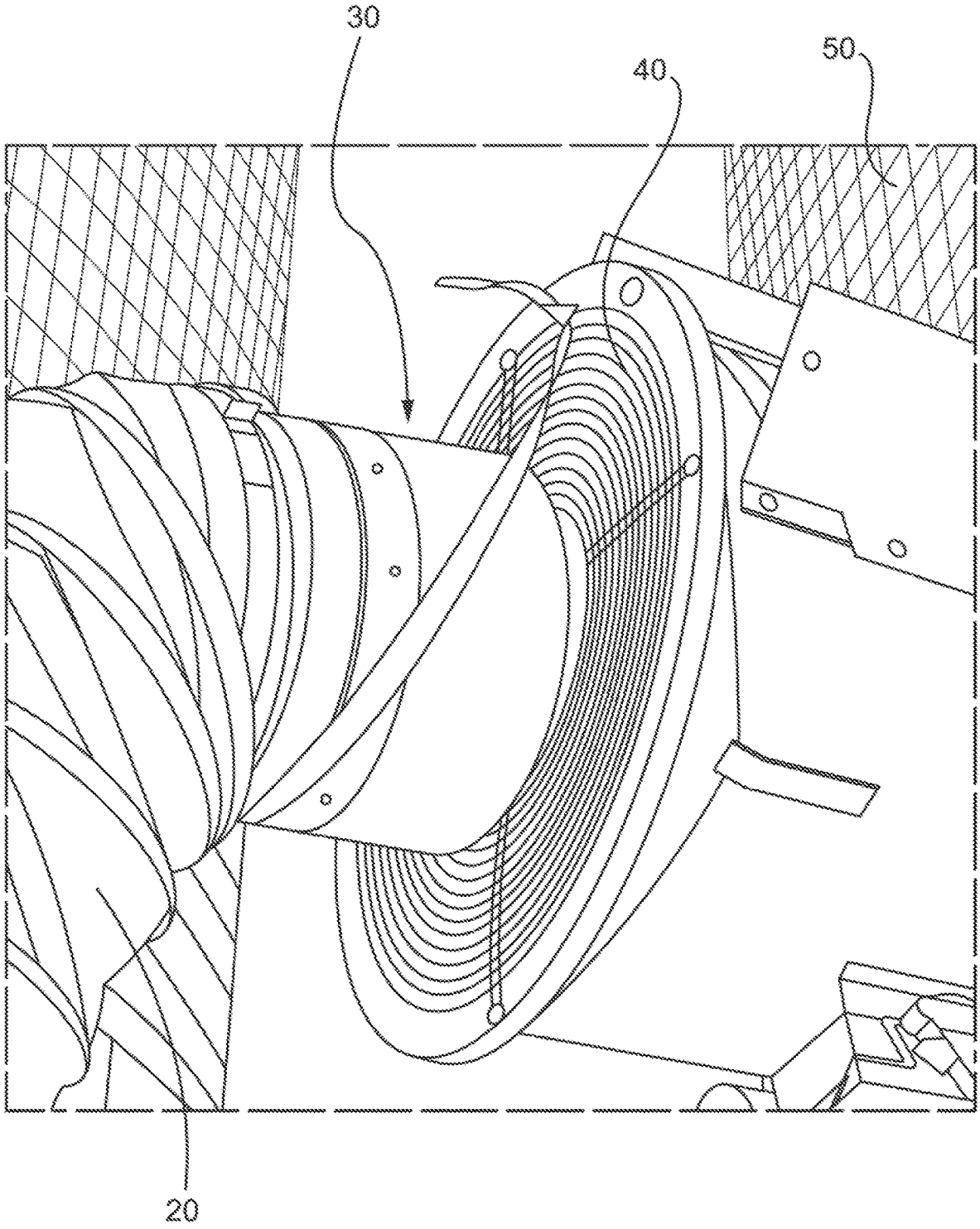
FIG. 2 illustrates a grain drying adapter connected to a fan of an aeration system of a grain bin.

FIG. 2 illustrates one embodiment of a grain drying adapter 30 connected to a fan of an aeration system of a grain bin. The grain drying adapter 30 is designed to hook or connect to a front (air introduction portion) of the fan 40.

Figure 3:
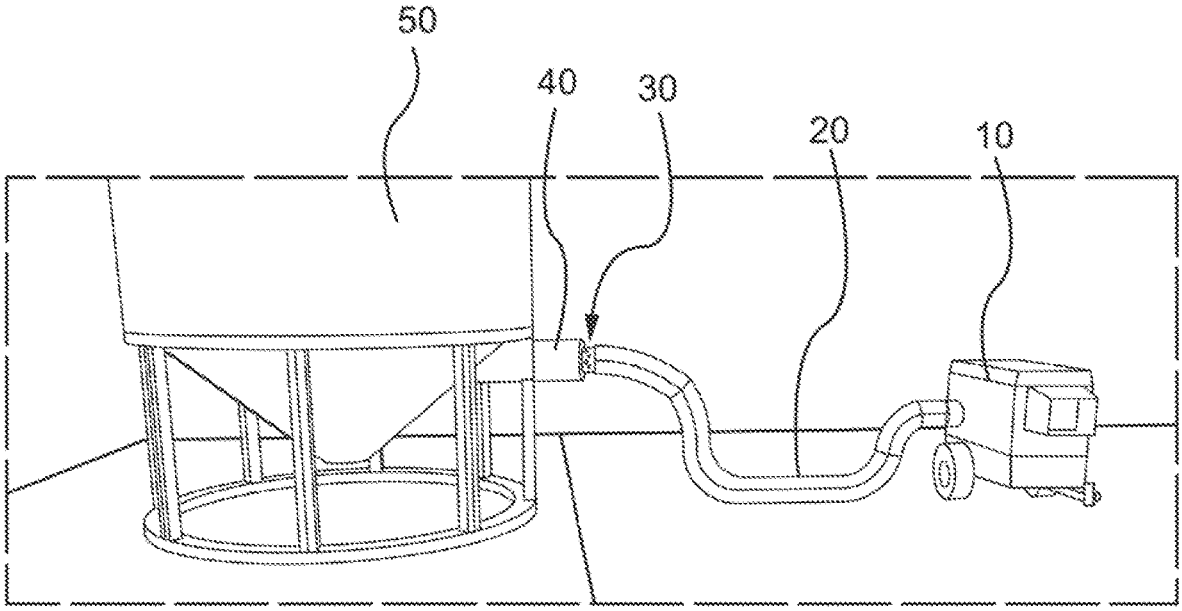
FIG. 3 illustrates a heating system, including a heating unit connected to a ducting connected to a grain drying adapter.

FIG. 3 illustrates one embodiment of heating unit 10 connected to a ducting 20 connected to a grain drying adapter 30 that is connected to a fan 40 of a grain bin 50.

Figure 4:
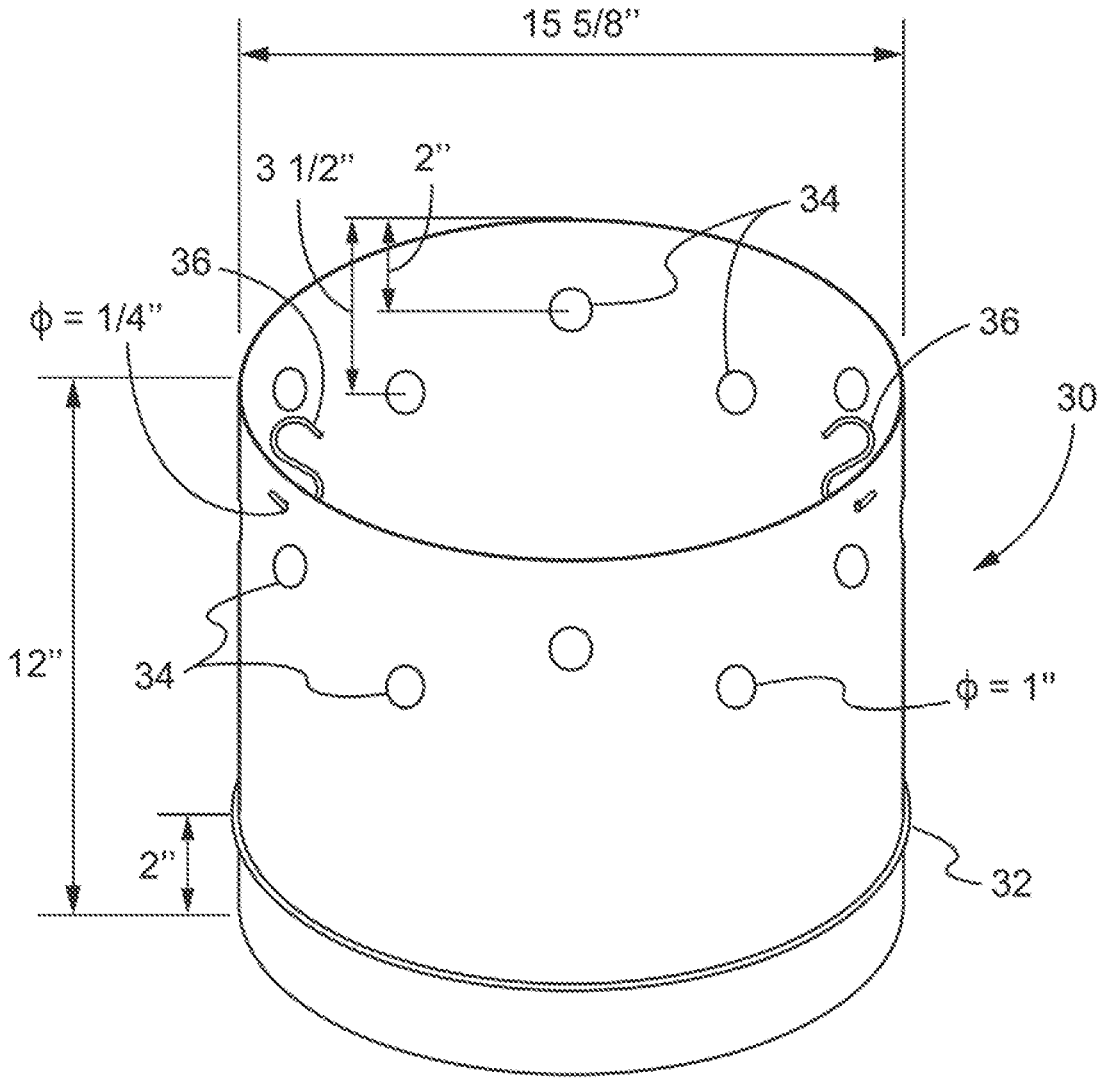
FIG. 4 illustrates one embodiment of a grain drying adapter, with dimensions.

FIG. 4 illustrates one embodiment of grain drying adapter 30. The adapter 30 may be formed from 24-gauge galvanized sheet metal, or any other known material that will withstand the temperature and outside elements (e.g., tin). The adapter 30 illustrated in this embodiment is substantially tubular (other shapes may be utilized, including square, rectangular, etc, so long as communicate at least partially with the fan 40), approximately 12" long and 15⅝" in diameter (other appropriate dimensions are suitable), and comprises a lip portion 32 on the ducting side of the adapter 30, a plurality of through-holes 34 formed on the fan side of the adapter 30, and at least one attachment component (e.g., S-hook) 36. In this embodiment, lip portion 32 is formed approximately 2" from an open end of the adaptor 30 (other appropriate dimensions are suitable). The attachment component and adapter 30 is designed to connect to different sized fans. The through-holes 34 may be arranged in one or more rows around the entire or non-entire circumference of the adapter 30. The through-holes may be spaced apart equidistant, but this is not necessary. The through-holes function to introduce ambient air to the fan 40 to be circulated into the bin 50 via the aeration system. Alternatively, the adapter 30 can designed with a screen on at least a portion of the adapter 30 to introduce ambient air to the fan 40.

The through-holes 34 may be positioned 1.5-6" from an open end of the adaptor 30. In the embodiment illustrated in FIG. 4, the through-holes 34 are staggered such that a first through-hole is located so that a center thereof is 2" from an open end of the adaptor 30 and an adjacent second through-hole is located so that a center thereof is 3.5" from the open end of the adaptor 30. Each of the through-holes 34 illustrated in FIG. 4 has a 1" diameter. Other suitable dimensions that maintain the structural integrity of the adaptor 30 and permit adequate ambient airflow into the adaptor 30 may also be utilized.

The air introduced via heating unit 10 alone is too hot for certain grain drying applications (e.g. 5000 CFM). The adapter 30 is designed to attach (e.g., S-hooks) to front of the fan 40 and allows a predetermined volume of ambient air (e.g., cooler) air to mix with the hot air from the outlet of the heating unit 10 before being introduced to the aeration system of the grain bin 50. In operation, a blend of heated air from the running heating unit 10 (e.g., heated air stream or heated air flow) and ambient air from the through-holes 34 is introduced to the fan 40 and circulated into the bin 50 via the aeration system. The heated air stream is typically 160-200 degrees Fahrenheit. The blend may have a temperature of approximately 85-95 degrees Fahrenheit. The heater air stream flow rate is approximately 5000 cfm (cubic feet per minute). The aeration bin air flow is approximately 7000-20,000 cfm. (air flow rate changes based on specific fan used with grain bin aeration system).

The grain drying adapter 30 may be configured to include staggered holes 34 arranged in two rows around the circumference of the adapter 30. Staggering of the holes improves the strength of the adapter 30, while allowing for predetermined and desired volume of ambient air introduction into the aeration system.

FIG. 4 illustrates an embodiment of the grain drying adapter 30 with connector elements 36 attached. In this embodiment, the elements 36 are S-hooks (any known alternative fastening element maybe used) that are two-inches long (other length and shape can be used) and attached to the adapter 30 at one end thereof through one-inch diameter hole (other holes suitable for selected connecter dimension may be used).

Figure 5:
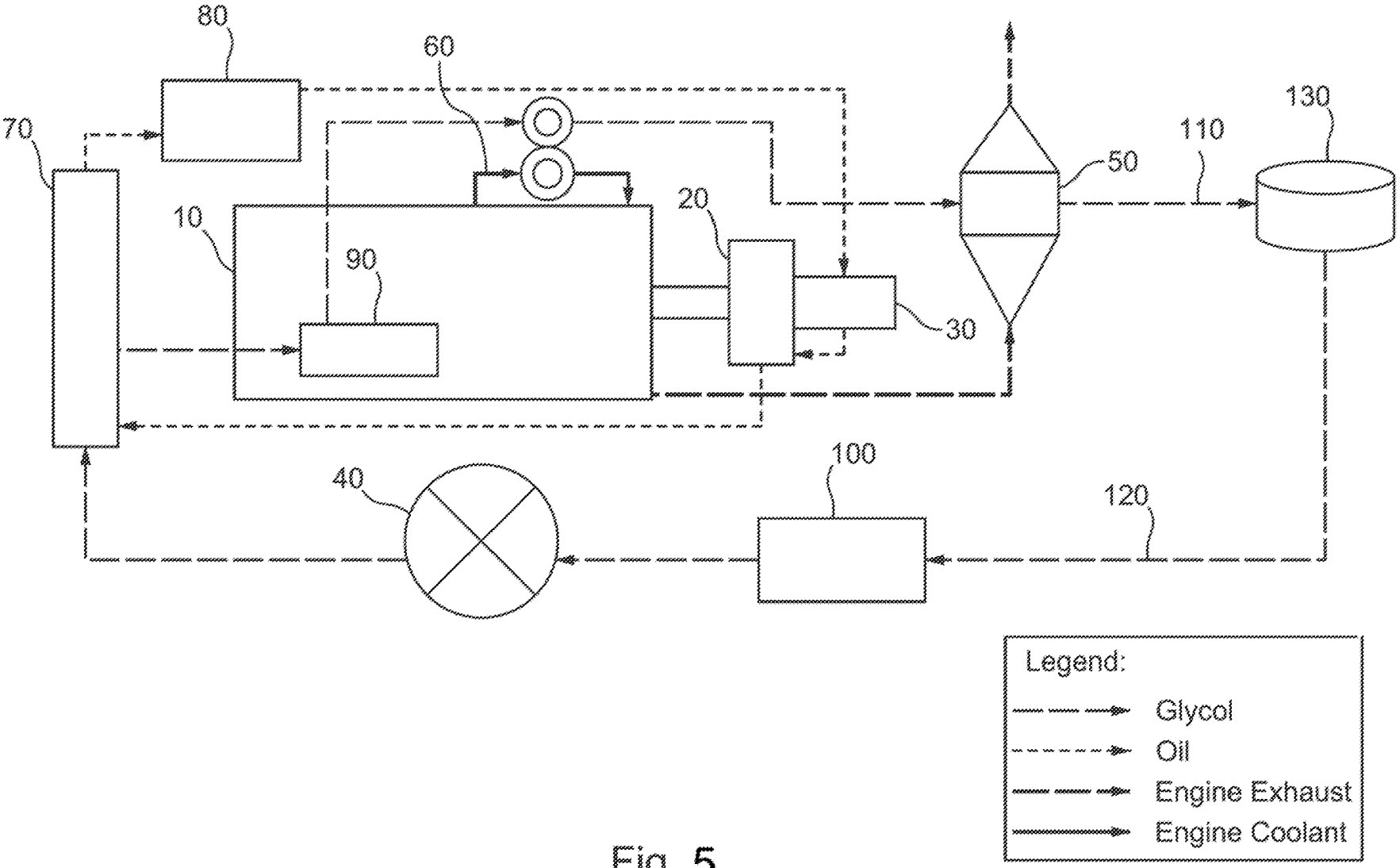
FIG. 5 illustrates one embodiment of a heating unit.

FIG. 5 illustrates one embodiment of a heating unit that may be used to generate the heated air that is introduced into the aeration system. Other suitable heating units may be used to introduce heated air into the aeration system.

Although embodiments have been described above and illustrated in the accompanying drawings to be more clearly understood, the above description is made by way of example and not as a limitation to the scope of the instant invention. It is contemplated that various modifications to one of ordinary skill in the art could be made without departing from the scope of the invention which is to be determined by the following claims.

We claim:

1. A grain dying system for a grain bin, comprising:

a heating unit arranged in a proximity of the grain bin;

a flexible elongated ducting having a first end portion and a second end portion opposite the first end portion in a lengthwise direction thereof, wherein the first end portion of the ducting is directly connected to an outlet of the heating unit;

a grain drying adaptor comprising a first end portion, a second end portion opposite the first end portion thereof, and a plurality of spaced apart through-holes in a wall portion thereof, wherein the first end portion of the grain drying adaptor is connected to the second end portion of the ducting; and a fan unit of an aeration system for the grain bin, the fan unit comprising a first end portion and a second end portion, wherein the second end portion of the grain drying adaptor is attached to the first end portion of the fan unit, the grain drying adaptor, connected to the second end portion of the ducting and attached to the first end portion of the fan unit, is configured to simultaneously introduce heated air from the heating unit, and ambient air from outside the grain drying adaptor via the through-holes, into the aeration system of said grain bin.

2. The grain drying system for a grain bin of claim 1, wherein each of the through-holes of the plurality of through-holes is alternatively staggered in two rows around a circumference of the grain drying adaptor.

3. The grain drying system for a grain bin of claim 1, wherein the heating unit is configured to release air heat to the ducting via the outlet component of the heating unit.

4. The grain drying system for a grain bin of claim 3, wherein the second end portion of the ducting comprises second end portion A and second end portion B, wherein second end portion A is attached to the grain bin and second end portion B is attached to a second grain bin.

5. The grain drying system for a grain bin of claim 1, wherein the grain drying adaptor is connected to the first end portion of the fan by a hook component.

6. The grain drying system for a grain bin of claim 1, wherein the grain drying adaptor is substantially tubular shaped.

7. The grain drying system for a grain bin of claim 1, wherein the grain drying adaptor comprises a screen portion designed to introduce the ambient air to the fan.

8. The grin drying system for a grain bin of claim 1, wherein the blend of air introduced into the aeration system is 85-95 degrees Fahrenheit.

9. The grain drying system for a grain bin of claim 1, wherein the heating unit is a mobile heating unit.

* * * * *